US010460540B2

(12) United States Patent
Mahar et al.

(10) Patent No.: US 10,460,540 B2
(45) **Date of Patent: *Oct. 29, 2019**

(54) SMART DOORMAN

(71) Applicant: Vivint, Inc., Provo, UT (US)

(72) Inventors: Matthew Mahar, Salt Lake City, UT (US); Matthew J. Eyring, Provo, UT (US); Clint Huson Gordon-Carroll, Orem, UT (US); Jeremy B. Warren, Draper, UT (US); James Ellis Nye, Alpine, UT (US); Jefferson Huhta Lyman, Alpine, UT (US)

(73) Assignee: Vivint, Inc., Provo, UT (US)

( * ) Notice: Subject to any disclaimer, the term of this patent is extended or adjusted under 35 U.S.C. 154(b) by 46 days.

This patent is subject to a terminal disclaimer.

(21) Appl. No.: 15/728,173

(22) Filed: Oct. 9, 2017

(65) Prior Publication Data

US 2018/0096548 A1 Apr. 5, 2018

Related U.S. Application Data

(63) Continuation of application No. 14/629,134, filed on Feb. 23, 2015, now Pat. No. 9,786,107.

(51) Int. Cl.
*G07C 9/00* (2006.01)

(52) U.S. Cl.
CPC ..... *G07C 9/00158* (2013.01); *G07C 9/00166* (2013.01)

(58) Field of Classification Search
CPC ..... G07C 9/00158; G07C 9/00166; H04L 12/2816
See application file for complete search history.

(56) References Cited

U.S. PATENT DOCUMENTS

| | | | |
|---|---|---|---|
| 8,193,904 | B2 | 6/2012 | Kawakita |
| 8,750,576 | B2 | 6/2014 | Huang et al. |
| 2013/0017812 | A1 | 1/2013 | Foster |
| 2013/0031611 | A1 | 1/2013 | Barreto |
| 2013/0263227 | A1 | 10/2013 | Gongaware et al. |
| 2014/0071273 | A1 | 3/2014 | Balthasar et al. |

(Continued)

FOREIGN PATENT DOCUMENTS

| | | | |
|---|---|---|---|
| KR | 101046655 | B1 | 7/2011 |
| KR | 101305371 | B1 | 9/2013 |

OTHER PUBLICATIONS

PCT International Search Report for PCT International Application No. PCT/US2016/014905, dated Apr. 29, 2016 (3 pp.).

*Primary Examiner* — Nabil H Syed
(74) *Attorney, Agent, or Firm* — Holland & Hart LLP

(57) ABSTRACT

An automation system may include a smart doorman. The system may observe one or more guests to a residence, predict a user profile associated with the guest, and invite an administrator of the automation system to create the suggested profile of the guest. The system may store one or more biometric identifiers with a visitation pattern to determine if the guest requires a profile. In one embodiment, a method for security and/or automation systems may be described. The method may include detecting the presence of one or more guests at an entrance to a residence and comparing the presence of a guest to one or more profile parameters. A guest profile associated with the guest may be predicted based at least in part on the comparing.

21 Claims, 8 Drawing Sheets

(56) References Cited

U.S. PATENT DOCUMENTS

| | | | |
|---|---|---|---|
| 2014/0136106 | A1 | 5/2014 | Chakraborty et al. |
| 2014/0266669 | A1 | 9/2014 | Fadell et al. |
| 2015/0156031 | A1* | 6/2015 | Fadell ..... H04L 12/2816 700/276 |
| 2015/0167995 | A1 | 6/2015 | Fadell et al. |

* cited by examiner

SMART DOORMAN

CROSS REFERENCES

The present application is a continuation of U.S. patent application Ser. No. 14/629,134, titled: "SMART DOORMAN," filed on Feb. 23, 2015. The disclosure of which is incorporated in its entirety by reference herein.

BACKGROUND

The present disclosure, for example, relates to security and/or automation systems, and more particularly to allow guests to access a building using a smart doorman.

Security and automation systems are widely deployed to provide various types of communication and functional features such as monitoring, communication, notification, and/or others. These systems may be capable of supporting communication with a user through a communication connection or a system management action.

In some instances, a user may have to manually input or load user profiles to allow a new user to access the automation system. This can be cumbersome and time consuming A profile may be required for guests even if the guest is visiting for short duration. A traditional key or key code may be difficult to remember and present the guest with needing to find the key or find a piece of paper or note where the key code is located. The guest may lose the key code or the key and present a security risk for the residence.

SUMMARY

In some embodiments, the automation system may act as a virtual doorman and allow people to enter a premise based at least in part on one or more biometric features. The system may observe one or more guests to a residence, predict characteristics of a user profile associated with the guest, and invite an administrator of the automation system to edit, approve, or reject the suggested profile of the guest. The guests may be friends, family, delivery personnel, contractors, and the like. The system may record biometric identifiers such as thumbprints, facial features, voice recognition, and the like. The system may store the biometric identifiers with a visitation pattern to determine if the guest requires a profile.

In one embodiment, a method for security and/or automation systems may be described. The method may include detecting the presence of one or more guests at an entrance to a residence and comparing the presence of a guest to one or more profile parameters. A guest profile associated with the guest may be predicted based at least in part on the comparing.

A presence of the one or more guests may be tracked. Visitation parameters of the one or more guests may be recorded based in part on the tracking. The visitation parameters may be analyzed based at least in part on the recording. An inactive profile may be generated based at least in part on the analyzing. One or more visitation parameters may be stored with the inactive profile. The predicting may be based at least in part on the inactive profile.

A guest profile may be generated based at least in part on the inactive profile. A suggested guest profile may be provided to an administrator of an automation system based at least in part on the predicting. The suggested profile may comprise one or more access parameters. The one or more access parameters may comprise one or more of a predetermined time period of access, a daily timeframe access, and access areas.

Input from the administrator may be requested to approve, edit, or reject the suggested guest profile. User input may be received to approve the suggested guest profile. A guest profile may be activated based at least in part on the receiving. The detecting may be compared to the presence of at least one user of the automation system.

In another embodiment, an apparatus for security and/or automation systems may be disclosed. The apparatus may comprise a processor, memory in electronic communication with the processor, and, instructions stored in the memory. The instructions may be executable by the processor to detect the presence of one or more guests at an entrance to a residence, compare the presence of a guest to one or more profile parameters, and predict a guest profile associated with the guest based at least in part on the comparing.

In another embodiment, a non-transitory computer-readable medium storing computer-executable code is described. The code may be executable by a processor to detect the presence of one or more guests at an entrance to a residence, compare the presence of a guest to one or more profile parameters, and predict a guest profile associated with the guest based at least in part on the comparing.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

A smart (or virtual) doorman may allow people to enter a premise based on one or more biometric features. People may require a user profile to enter the premise and may include a user of the automation system. The premise may comprise a building or grounds associated with an automation system. Guests to an automation system may be added to the automation system to allow their own entry and use of the premise without the need for other users to allow them entry. Adding a guest as a user may be cumbersome and time consuming. A smart doorman may increase the efficiency of adding guest users. The smart doorman may detect the presence of one or more guests entering a house, as well as a pattern of attendance and access. The automation system may use the detected information to predict a profile for the guest and suggest the profile to an administrator of the automation system. The administrator may alter one or more settings of the profile and approve the profile. While the term guest is used herein in the singular, guest may additionally comprise one or more persons. Guests may comprise any person without a profile to the automation system and/or particular building.

The following description provides examples and is not limiting of the scope, applicability, and/or examples set forth in the claims. Changes may be made in the function and/or arrangement of elements discussed without departing from the scope of the disclosure. Various examples may omit, substitute, and/or add various procedures and/or components as appropriate. For instance, the methods described may be performed in an order different from that described, and/or various steps may be added, omitted, and/or combined. Also, features described with respect to some examples may be combined in other examples.

Figure 1:
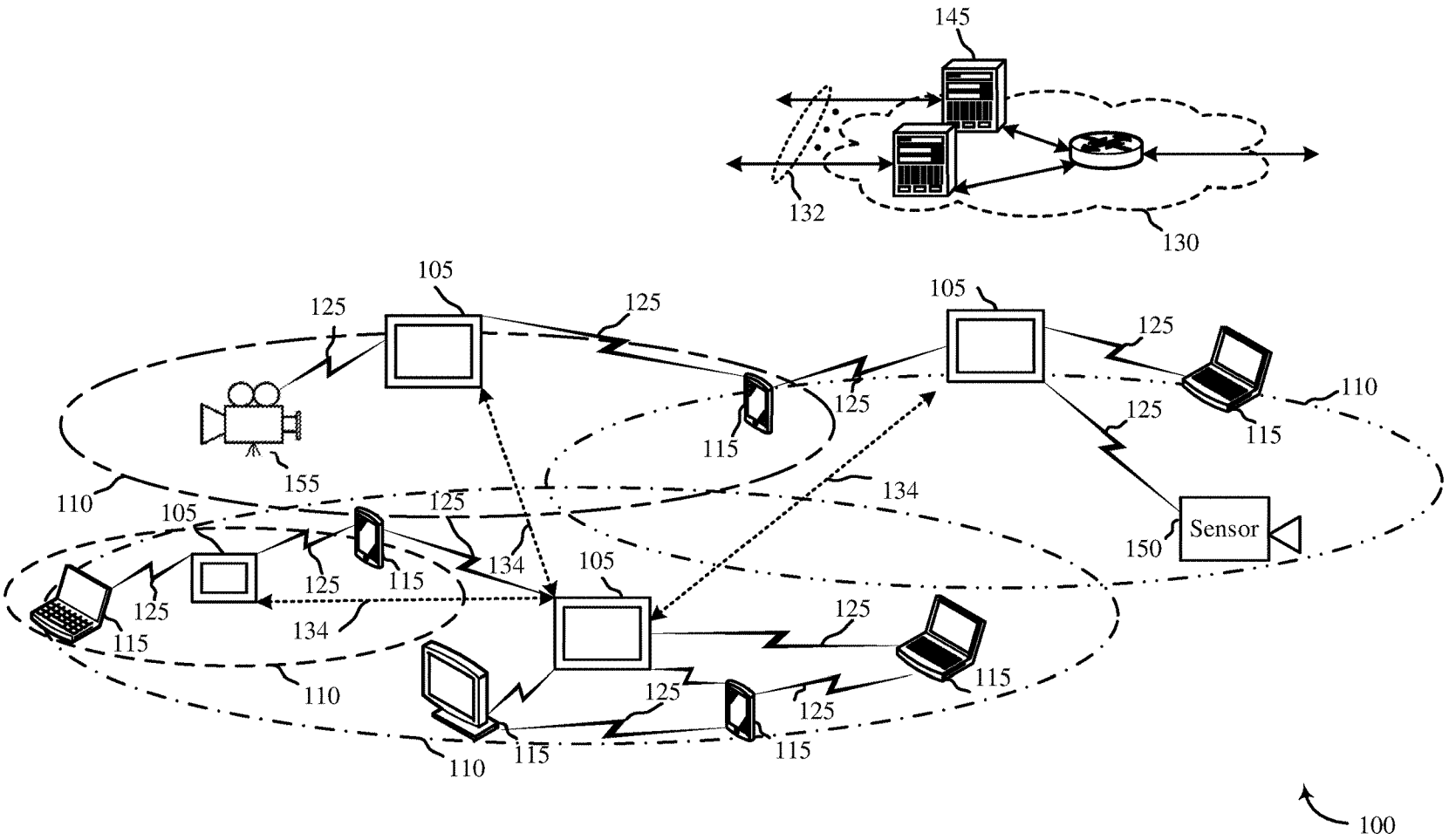
FIG. 1 shows a block diagram relating to a security and/or an automation system, in accordance with various aspects of this disclosure.

FIG. 1 illustrates an example of a communications system 100 in accordance with various aspects of the disclosure. The communications system 100 may include control panels 105, devices 115, a network 130, sensors 150, and/or security cameras 155. The network 130 may provide user authentication, encryption, access authorization, tracking, Internet Protocol (IP) connectivity, and other access, calculation, modification, and/or functions. The control panels 105 may interface with the network 130 through wired and/or wireless communication links 132 to communication with one or more remote servers 145. The control panels 105 may perform communication configuration, adjustment, and/or scheduling for communication with the devices 115, or may operate under the control of a controller. In various examples, the control panels 105 may communicate—either directly or indirectly (e.g., through network 130)—with each other over wired and/or wireless communication links 134. Control panels 105 may communicate with a back end server (such as the remote servers 145)—directly and/or indirectly—using one or more communication links.

The control panels 105 may wirelessly communicate with the devices 115 via one or more antennas. Each of the control panels 105 may provide communication coverage for a respective geographic coverage area 110. In some examples, control panels 105 may be referred to as a control device, a base transceiver station, a radio base station, an access point, a radio transceiver, or some other suitable terminology. The geographic coverage area 110 for a control panel 105 may be divided into sectors making up only a portion of the coverage area. The communications system 100 may include control panels 105 of different types. There may be overlapping geographic coverage areas 110 for one or more different parameters, including different technologies, features, subscriber preferences, hardware, software, technology, and/or methods. For example, each control panel 105 may be related to one or more discrete structures (e.g., a home, a business) and each of the one more discrete structures may be related to one or more discrete areas. In other examples, multiple control panels 105 may be related to the same one or more discrete structures (e.g., multiple control panels relating to a home and/or a business complex).

The devices 115 may be dispersed throughout the communications system 100 and each device 115 may be stationary and/or mobile. A device 115 may include a cellular phone, a personal digital assistant (PDA), a wireless modem, a wireless communication device, a handheld device, a tablet computer, a laptop computer, a cordless phone, a wireless local loop (WLL) station, a display device (e.g., TVs, computer monitors, etc.), a printer, a camera, and/or the like. A device 115 may also include or be referred to by those skilled in the art as a user device, a smartphone, a BLUETOOTH® device, a Wi-Fi device, a mobile station, a subscriber station, a mobile unit, a subscriber unit, a wireless unit, a remote unit, a mobile device, a wireless device, a wireless communications device, a remote device, an access terminal, a mobile terminal, a wireless terminal, a remote terminal, a handset, a user agent, a mobile client, a client, and/or some other suitable terminology.

The control panels 105 may wirelessly communicate with the sensors 150 via one or more antennas. The sensors 150 may be dispersed throughout the communications system 100 and each sensor 150 may be stationary and/or mobile. A sensor 150 may include and/or be one or more sensors that sense: proximity, motion, temperatures, humidity, sound level, smoke, structural features (e.g., glass breaking, window position, door position), time, light geo-location data of a user and/or a device, distance, biometrics, weight, speed, height, size, preferences, light, darkness, weather, time, system performance, and/or other inputs that relate to a security and/or an automation system. A device 115 and/or a sensor 150 may be able to communicate through one or more wired and/or wireless connections with various components such as control panels, base stations, and/or network equipment (e.g., servers, wireless communication points, etc.) and/or the like.

The control panels 105 may wirelessly communicate with the security cameras 155 via one or more antennas. The security cameras 155 may be dispersed throughout the communications system 100 and each security camera 155 may be stationary and/or mobile. A security camera 155 may include and/or be one or more cameras that capture still images, moving images such as video, audio, audiovisual data, and the like. The security camera 155 may operate in daylight or at night. A device 115 and/or a security camera 155 may be able to communicate through one or more wired and/or wireless connections with various components such as control panels, base stations, and/or network equipment (e.g., servers, wireless communication points, etc.), and/or the like.

The communication links 125 shown in communications system 100 may include uplink (UL) transmissions from a device 115 to a control panel 105, and/or downlink (DL) transmissions, from a control panel 105 to a device 115. The downlink transmissions may also be called forward link transmissions while the uplink transmissions may also be called reverse link transmissions. Each communication link 125 may include one or more carriers, where each carrier may be a signal made up of multiple sub-carriers (e.g., waveform signals of different frequencies) modulated according to the various radio technologies. Each modulated signal may be sent on a different sub-carrier and may carry control information (e.g., reference signals, control channels, etc.), overhead information, user data, etc. The communication links 125 may transmit bidirectional communications and/or unidirectional communications. Communication links 125 may include one or more connections, including but not limited to, 345 MHz, Wi-Fi, BLUETOOTH®, BLUETOOTH® Low Energy, cellular, Z-WAVE®, 802.11, peer-to-peer, LAN, WLAN, Ethernet, fire wire, fiber optic, and/or other connection types related to security and/or automation systems.

In some embodiments, of communications system 100, control panels 105 and/or devices 115 may include one or more antennas for employing antenna diversity schemes to improve communication quality and reliability between control panels 105 and devices 115. Additionally or alternatively, control panels 105 and/or devices 115 may employ multiple-input, multiple-output (MIMO) techniques that may take advantage of multi-path, mesh-type environments to transmit multiple spatial layers carrying the same or different coded data.

While the devices 115 may communicate with each other through the control panel 105 using communication links 125, each device 115 may also communicate directly with one or more other devices via one or more direct communication links 125. Two or more devices 115 may communicate via a direct communication link 125 when both devices 115 are in the geographic coverage area 110 or when one or neither devices 115 is within the geographic coverage area 110. Examples of direct communication links 125 may include Wi-Fi Direct, BLUETOOTH®, wired, and/or, and other P2P group connections. The devices 115 in these examples may communicate according to the WLAN radio and baseband protocol including physical and MAC layers from IEEE 802.11, and its various versions including, but not limited to, 802.11b, 802.11g, 802.11a, 802.11n, 802.11ac, 802.11ad, 802.11ah, etc. In other implementations, other peer-to-peer connections and/or ad hoc networks may be implemented within communications system 100.

The security cameras 155 may be dispersed throughout a building or may be proximate each entrance to a building. The entrances may comprise windows, doors, or the like. The security cameras 155 may detect and use one or more biometric features to positively identify each person entering the building. The one or more biometric features may be compared to one or more profiles associated with the building. If the biometric features match a profile, the person may be granted access to the building according to their profile. If a guest is accompanying the user, the guest's biometric identifier may be stored. An inactive profile for the guest may be created. The inactive profile may not grant the guest access to the system but may track the visitation times and access points of the guest for future use. In some embodiments, an administrator of the automation system may be presented with a draft or proposed profile outlining the guest and predicted access parameters. The administrator may accept, alter, or reject the profile.

Figure 2:
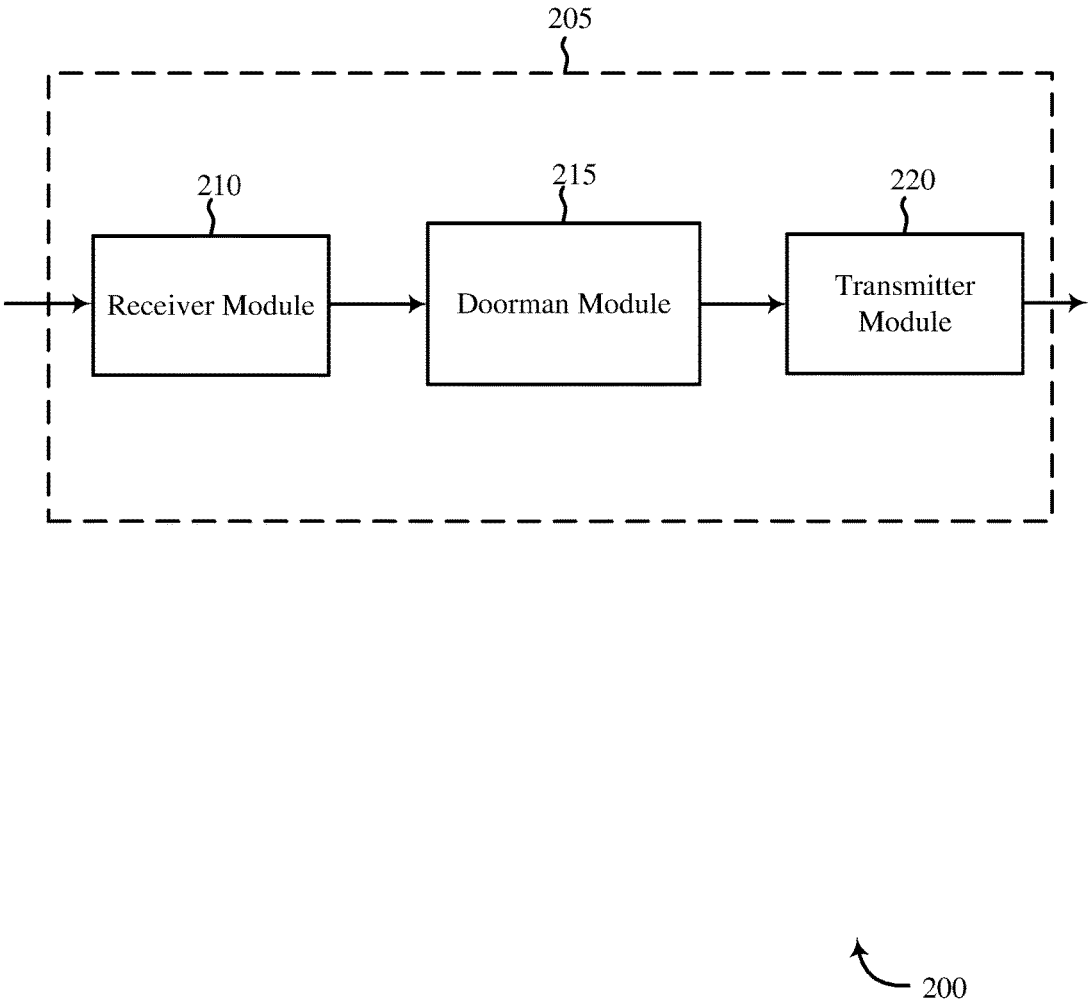
FIG. 2 shows a block diagram of a device relating to a security and/or an automation system, in accordance with various aspects of this disclosure.

FIG. 2 shows a block diagram 200 of a control panel 205 for use in electronic communication, in accordance with various aspects of this disclosure. The control panel 205 may be an example of one or more aspects of a control panel 105 described with reference to FIG. 1. The control panel 205 may include a receiver module 210, a doorman module 215, and/or a transmitter module 220. The control panel 205 may also be or include a processor. Each of these modules may be in communication with each other—directly and/or indirectly.

The components of the control panel 205 may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver module 210 may receive information such as packets, user data, and/or control information associated with various information channels (e.g., control channels, data channels, etc.). The receiver module 210 may be configured to receive audio, video, or audiovisual data from a security camera (e.g. security camera 155) and/or other data from sensors and/or other devices proximate an entry to a building. Information may be passed on to the doorman module 215, and to other components of the control panel 205.

The doorman module 215 may predict one or more profiles for a guest to the automation system. The doorman module 215 may gather information relative to a guest to the automation system and use the information to predict a user profile for the guest. The information may comprise actual visiting information for the guest including times of visitation, duration of visitation, users visited, areas of a building accessed, and the like. The information may additionally comprise one or more biometric identifiers such as facial recognition, fingerprinting, voice recognition, and the like.

Additionally, the doorman module 215 may receive information from other sources. For example, the doorman module 215 may access a calendar of the automation system and determining a pending guest will be visiting. The doorman module 215 may develop a short term profile for the particular guest including access levels. The access levels may be based on information contained within the calendar notice, or may comprise default settings for active guest profiles. The doorman module 215 may gather the information and send a profile authorization request to an administrator of the automation system for approval. The administrator may approve, alter, and/or reject the profile. The profile may allow the guest to enter the premises using one or more biometric identifiers.

The transmitter module 220 may transmit the one or more signals received from other components of the control panel 205. The transmitter module 220 may transmit one or more suggested profiles and/or inactive profiles to an administrator or other user of an automation system. In some examples, the transmitter module 220 may be collocated with the receiver module 210 in a transceiver module.

Figure 3:
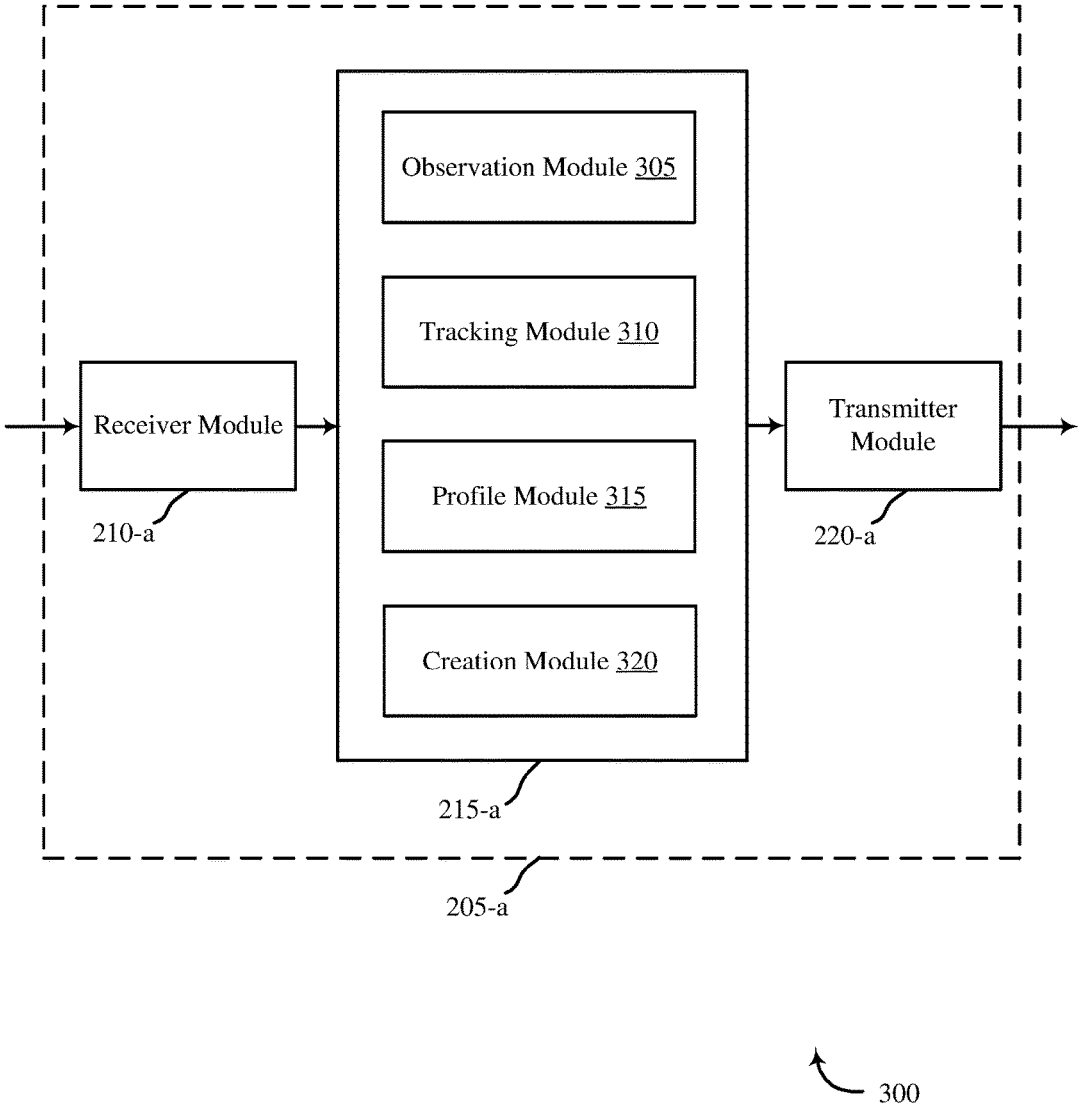
FIG. 3 shows a block diagram of a device relating to a security and/or an automation system, in accordance with various aspects of this disclosure.

FIG. 3 shows a block diagram 300 of a control panel 205-*a* for use in wireless communication, in accordance with various examples. The control panel 205-*a* may be an example of one or more aspects of a control panel 105 described with reference to FIG. 1. It may also be an example of a control panel 205 described with reference to FIG. 2. The control panel 205-*a* may include a receiver module 210-*a*, a doorman module 215-*a*, and/or a transmitter module 220-*a*, which may be examples of the corresponding modules of control panel 205. The control panel 205-*a* may also include a processor. Each of these components may be in communication with each other. The doorman module 215-*a* may include an observation module 305, a tracking module 310, a profile module 315, and a creation module 320. The receiver module 210-*a* and the transmitter module 220-*a* may perform the functions of the receiver module 210 and the transmitter module 220, of FIG. 2, respectively.

The observation module 305 may identify a guest entering a residence. The guest may be accompanied by a user, may be permitted entry by a user, may possess a key or key code, or the like. The system may record one or more biometric features of the guest and record entry and exit times, where applicable. The biometric features may comprise facial features, voice recognition, fingerprint, and the like. The entry and exit times may comprise a time of day, calendar day, holiday, and the like. The observation module 305 may compare the visit to one or more calendar events. The calendar events may comprise birthdays, special occasions, calendar events, and the like. The observation module 305 may send the information to the tracking module 310.

The tracking module 310 may record all of the information related to each guest and store the information in an inactive profile. The tracking module 310 may analyze the guest information to determine a pattern of visitation. The pattern of visitation may comprise determining trends between each visit the guest has to the premise. For example, some family members may only visit during birthdays. Other personnel may appear weekly. Groundskeeper may access the garage and/or shed. Cleaning personnel may enter a building every other Wednesday. A laundromat service may pick up dry cleaning on Mondays and drop it off on Fridays. The tracking module 310 may detect the patterns correlating to a visit.

The tracking module 310 may additionally predict future guests to the house. For example, the tracking module 310 may review a calendar associated with the building. The calendar may comprise an event detailing the overnight visit of one or more guests to a residence. The tracking module 310 may determine if the guest has visited previously and the parameters and details surrounding the previous visit. Alternatively, the tracking module 310 may review a user's interaction with the guest. For example, the pending guests may be stored in a contact list which may include information about the guest. The tracking module 310 may deliver this information to the profile module 315 which may generate a suggested profile for the guest.

The profile module 315 may generate a suggested profile which may include a suggested list of access permissions for a guest to the automation system. A guest may comprise a person with non-regular access. The access permissions may comprise a predetermined time frame in which access is allowed, selected areas where access is granted, a time period of allowed access, and the like. A predetermined time frame may be a limited duration of access to the automation system. Alternatively, the predetermined time frame may list a recurring time of access the guest is permitted. The selected areas where access is granted may be specific to the guest. For example, groundskeepers may access the areas of the automation system wherein equipment may be stored. Mailmen may access an entry way to deposit packages. A time period of allowed access may limit the total durational time the guest may be allowed on the premise. For example, a mailman may be allowed ten minutes to drop off a package. Cleaning personnel may be allowed access for the entire working day. The suggested profile may additionally contain a suggested relation to the residence. The suggested relation may comprise a family member, a friend, a guest, a contractor, and the like. The suggested relation may be predicted from one or more calendar events of a user. The suggested relation may comprise a user the guest is linked to. The suggested user relation may be predicted from one or more users at the residence when the guests visits, one or more facial recognition features of users accompanying guests into the residence, specific calendar events of a user, and the like.

The profile module 315 may additionally include inactive profiles. The inactive profiles may comprise information from the tracking module 310. The profile module 315 may store one or more biometric features in an inactive profile. This may allow the tracking module 310 to analyze the information stored within an inactive profile. The profile module 315 may eventually develop enough information to generate a suggested profile from the inactive profile.

The creation module 320 may send the suggested profile to an administrator of the automation system. The administrator may view a photograph of the suggested user, the parameters of access, as well as a history of visitation. The administrator may have the option to approve, alter, or reject the profile. The administrator may alter any parameter of the suggested profile including the access permissions, visitation permissions, or the like. In some embodiments, the administrator may be able to request the continued tracking of the guest to determine if a profile may be necessary. In another embodiment, the administrator may approve the profile but not allow any access permissions and simply request a notification when the particular guest arrives. This may allow the administrator to be notified when select individuals are visiting the house. If the guest profile is approved, the creation module 320 may then activate the approved guest profile. This may grant the guest access to the automation system in accordance with the parameters outlined in the approved profile.

Figure 4:
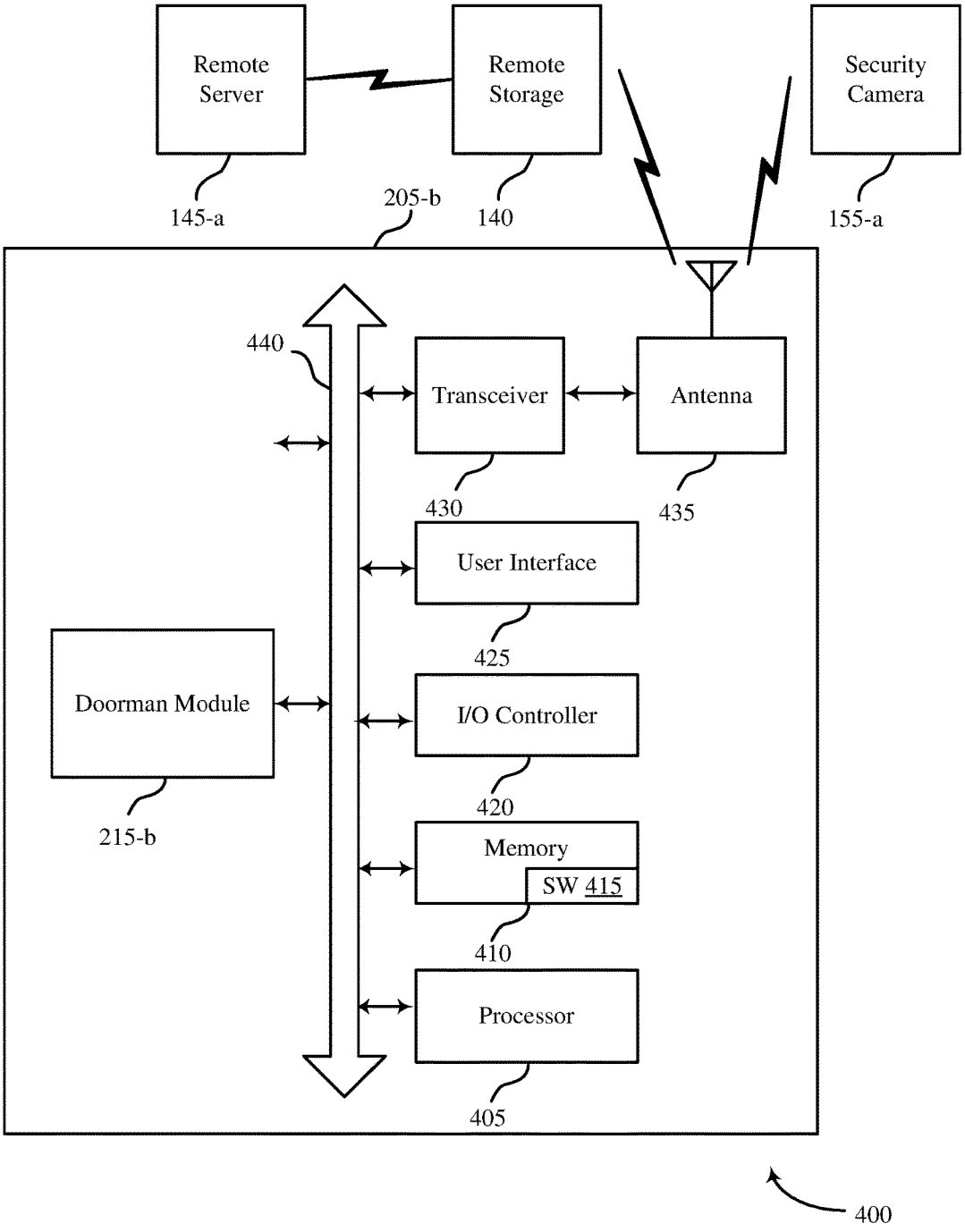
FIG. 4 shows a block diagram relating to a security and/or an automation system, in accordance with various aspects of this disclosure.

FIG. 4 shows a system 400 for use in smart doorman systems, in accordance with various examples. System 400 may include a control panel 205-*b*, which may be an example of the control panels 105 of FIG. 1. Control panel 205-*b* may also be an example of one or more aspects of control panels 205 and/or 205-*a* of FIGS. 2 and 3.

Control panel 205-*b* may also include components for bi-directional voice and data communications including components for transmitting communications and components for receiving communications. For example, control panel 205-*b* may communicate bi-directionally with one or more of security camera 155-*a*, remote storage 140, and/or remote server 145-*a*, which may be an example of the remote server of FIG. 1. This bi-directional communication may be direct (e.g., control panel 205-*b* communicating directly with remote storage 140) or indirect (e.g., control panel 205-*b* communicating indirectly with remote server 145-*a* through remote storage 140).

Control panel 205-*b* may also include a processor module 405, and memory 410 (including software/firmware code (SW) 415), an input/output controller module 420, a user interface module 425, a transceiver module 430, and one or more antennas 435 each of which may communicate—directly or indirectly—with one another (e.g., via one or more buses 440). The transceiver module 430 may communicate bi-directionally—via the one or more antennas 435, wired links, and/or wireless links—with one or more networks or remote devices as described above. For example, the transceiver module 430 may communicate bi-directionally with one or more of security camera 155-*a*, remote storage 140, and/or remote server 145-*a*. The transceiver module 430 may include a modem to modulate the packets and provide the modulated packets to the one or more antennas 435 for transmission, and to demodulate packets received from the one or more antenna 435. While a control panel or a control device (e.g., 205-*b*) may include a single antenna 435, the control panel or the control device may also have multiple antennas 435 capable of concurrently transmitting or receiving multiple wired and/or wireless transmissions. In some embodiments, one element of control panel 205-*b* (e.g., one or more antennas 435, transceiver module 430, etc.) may provide a direct connection to a remote server 145-*a* via a direct network link to the Internet via a POP (point of presence). In some embodiments, one element of control panel 205-*b* (e.g., one or more antennas 435, transceiver module 430, etc.) may provide a connection using wireless techniques, including digital cellular telephone connection, Cellular Digital Packet Data (CDPD) connection, digital satellite data connection, and/or another connection.

The signals associated with system 400 may include wireless communication signals such as radio frequency, electromagnetics, local area network (LAN), wide area network (WAN), virtual private network (VPN), wireless network (using 802.11, for example), 345 MHz, Z-WAVE®, cellular network (using 3G and/or LTE, for example), and/or other signals. The one or more antennas 435 and/or transceiver module 430 may include or be related to, but are not limited to, WWAN (GSM, CDMA, and WCDMA), WLAN (including BLUETOOTH® and Wi-Fi), WMAN (WiMAX), antennas for mobile communications, antennas for Wireless Personal Area Network (WPAN) applications (including RFID and UWB). In some embodiments, each antenna 435 may receive signals or information specific and/or exclusive to itself. In other embodiments, each antenna 435 may receive signals or information not specific or exclusive to itself.

In some embodiments, one or more security cameras 155-*a* (e.g., image, video, audio, audiovisual, etc.) may connect to some element of system 400 via a network using one or more wired and/or wireless connections.

In some embodiments, the user interface module 425 may include an audio device, such as an external speaker system, an external display device such as a display screen, and/or an input device (e.g., remote control device interfaced with the user interface module 425 directly and/or through I/O controller module 420).

One or more buses 440 may allow data communication between one or more elements of control panel 205-*b* (e.g., processor module 405, memory 410, I/O controller module 420, user interface module 425, etc.).

The memory 410 may include random access memory (RAM), read only memory (ROM), flash RAM, and/or other types. The memory 410 may store computer-readable, computer-executable software/firmware code 415 including instructions that, when executed, cause the processor module 405 to perform various functions described in this disclosure (e.g., identifying guests at a building, tracking information relating to guests, generating suggested profiles, etc.). Alternatively, the software/firmware code 415 may not be directly executable by the processor module 405 but may cause a computer (e.g., when compiled and executed) to perform functions described herein. Alternatively, the computer-readable, computer-executable software/firmware code 415 may not be directly executable by the processor module 405 but may be configured to cause a computer (e.g., when compiled and executed) to perform functions described herein. The processor module 405 may include an intelligent hardware device, e.g., a central processing unit (CPU), a microcontroller, an application-specific integrated circuit (ASIC), etc.

In some embodiments, the memory 410 can contain, among other things, the Basic Input-Output system (BIOS) which may control basic hardware and/or software operation such as the interaction with peripheral components or devices. For example, a doorman module 215-*b* to implement the present systems and methods may be stored within the system memory 410. Applications resident with system 400 are generally stored on and accessed via a non-transitory computer readable medium, such as a hard disk drive or other storage medium. Additionally, applications can be in the form of electronic signals modulated in accordance with the application and data communication technology when accessed via a network interface (e.g., transceiver module 430, one or more antennas 435, etc.).

Many other devices and/or subsystems may be connected to one or may be included as one or more elements of system 400 (e.g., entertainment system, computing device, remote cameras, wireless key fob, wall mounted user interface device, cell radio module, battery, alarm siren, door lock, lighting system, thermostat, home appliance monitor, utility equipment monitor, and so on). In some embodiments, all of the elements shown in FIG. 4 need not be present to practice the present systems and methods. The devices and subsystems can be interconnected in different ways from that shown in FIG. 4. In some embodiments, an aspect of some operation of a system, such as that shown in FIG. 4, may be readily known in the art and are not discussed in detail in this application. Code to implement the present disclosure can be stored in a non-transitory computer-readable medium such as one or more of system memory 410 or other memory. The operating system provided on I/O controller module 420 may be iOS®, ANDROID®, MS-DOS®, MS-WINDOWS®, OS/2®, UNIX®, LINUX®, or another known operating system.

The transceiver module 430 may include a modem configured to modulate the packets and provide the modulated packets to the antennas 435 for transmission and/or to demodulate packets received from the antennas 435. While the security cameras 155-*a* may include a single antenna 435, the security cameras 155-*a* may have multiple antennas 435 capable of concurrently transmitting and/or receiving multiple wireless transmissions.

The control panel 205-*b* may include the doorman module 215-*b*, which may perform the functions described above for the doorman module 215 of control panel 205 of FIGS. 2 and 3.

Figure 5:
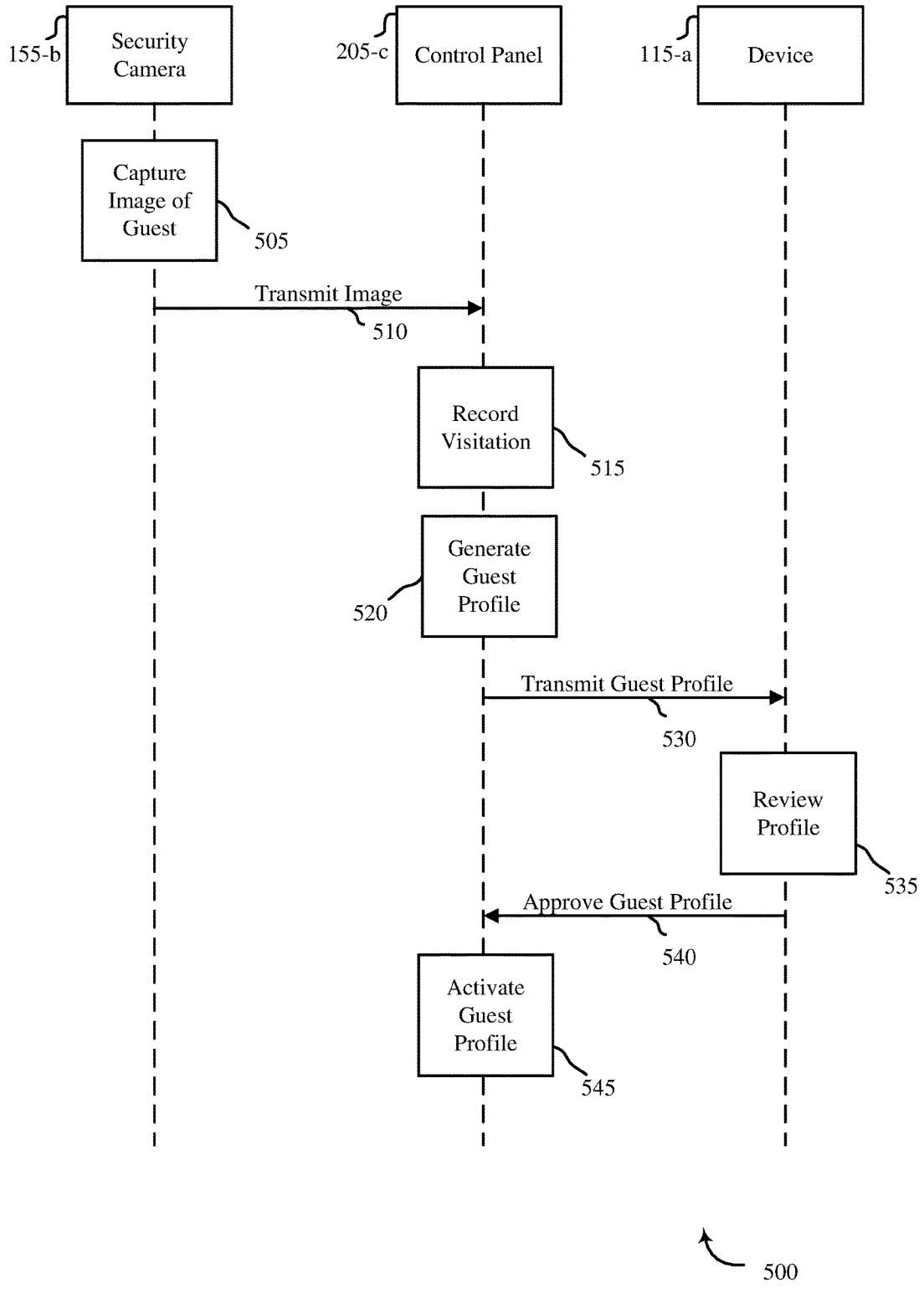
FIG. 5 shows a swim diagram of relating to a security and/or an automation system, in accordance with various aspects of this disclosure

FIG. 5 shows a system 500 for use in smart doorman systems, in accordance with various examples. System 500 may include a control panel 205-*c*, which may be an example of the control panels 105 of FIG. 1. Control panel 205-*c* may also be an example of one or more aspects of control panels 205, 205-*a*, and/or 205-*b* of FIGS. 2-4. System 500 may additionally include a security camera 155-*b*, which may be an example of the security camera 155, 155-*a* of FIGS. 1 and/or 4. System 500 may also include a device 115-*a*, which may be one example of a device 115 described with reference to FIG. 1. The device 115 may be associated with a user of the automation system.

The security camera 155-*b* may be proximate one or more entries to a building and/or grounds associated with an automation system. The security camera 155-*b* may capture the image of a guest 505 to the building. The security camera 155-*b* may transmit the image 510 to the control panel 205-*c*. The control panel 205-*c* may record the visitation 515 and all the parameters surrounding it. For example, the control panel 205-*c* may record a time of day, length of visit, areas visited, users associated with the visit, and the like. The control panel 205-*c* may generate a guest profile 520. The control panel 205-*c* may send the guest profile 530 to a device 115-*a* associated with a user and/or administrator of the automation system. The user may review the profile 535 on the device 115-*a*. If the user agrees with the profile, the user, via the device 115-*a* may approve the guest profile 540. Once the control panel 205-*c* receives the approval, the control panel 205-*c* may activate the guest profile 545.

Figure 6:
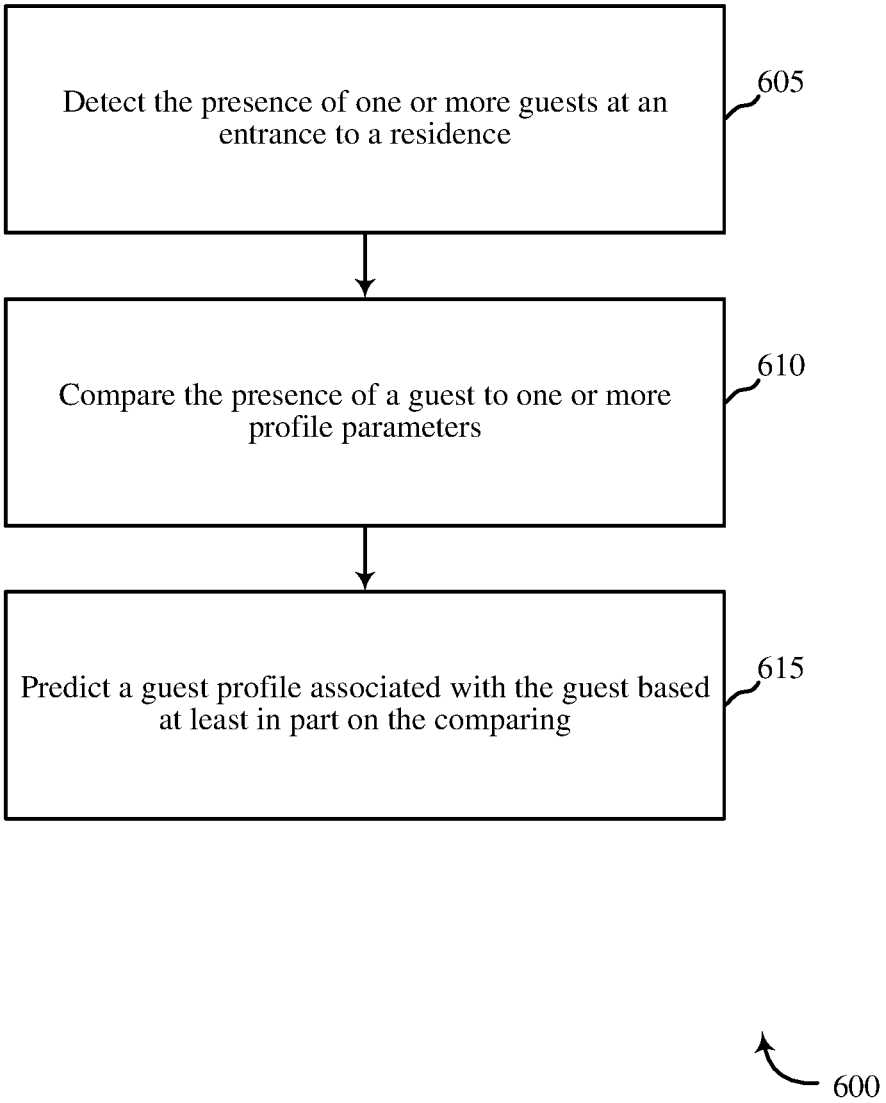
FIG. 6 is a flow chart illustrating an example of a method relating to a security and/or an automation system, in accordance with various aspects of this disclosure.

FIG. 6 is a flow chart illustrating an example of a method 600 for smart doorman systems, in accordance with various aspects of the present disclosure. For clarity, the method 600 is described below with reference to aspects of one or more of the doorman module 215 described with reference to FIGS. 2-4. In some examples, a control panel may execute one or more sets of codes to control the functional elements of one or more security cameras to perform the functions described below. Additionally or alternatively, the control panel may perform one or more of the functions described below using special-purpose hardware.

At block 605, the method 600 may include detecting the presence of one or more guests at an entrance to a residence. For example, a security camera may be proximate one or more entrances to a building and/or grounds associated with an automation system. The security camera may capture one or more faces of all personnel entering the grounds. The security camera may send the images to a control panel. The control panel may determine which of the personnel are users of the automation system and which personnel are guests. The control panel may then use one or more other sensors to track the parameters of the guests visitation. The parameters may include the timing of the visit, the correlation to one or more calendar events or holidays, length of visitation, areas accessed by the guest, and the like.

The operation(s) at block 605 may be performed using the observation module 305 and tracking module 310 described with reference to FIG. 3.

At block 610, the method 600 may include comparing the presence of a guest to one or more profile parameters. The profile parameters may comprise a predetermined time period of access, a daily timeframe access, access areas, and the like. The chosen profile parameters may be based at least in part on a history of guest visitation. Each time the guest visits, the visitation parameters may be recorded and may provide a basis for one or more profile parameters At block 615, the method 600 may include predicting a guest profile associated with the guest based at least in part on the comparing. The guest profile may consist of one or more profile parameters that match the guest's visitation parameters. The guest profile may be of a limited duration. For example, if the guest profile is based on one or more calendar events, the guest profile may only be active during the duration of the calendar event. The guest profile may additionally be of a limited access period and access area. For example, a mailman may be allowed to enter a residence for a brief duration to deliver packages to the front entryway.

The operation(s) at block 610 and 615 may be performed using the profile module 315 described with reference to FIG. 3.

Thus, the method 600 may provide for a smart doorman system relating to automation/security systems. It should be noted that the method 600 is just one implementation and that the operations of the method 600 may be rearranged or otherwise modified such that other implementations are possible.

Figure 7:
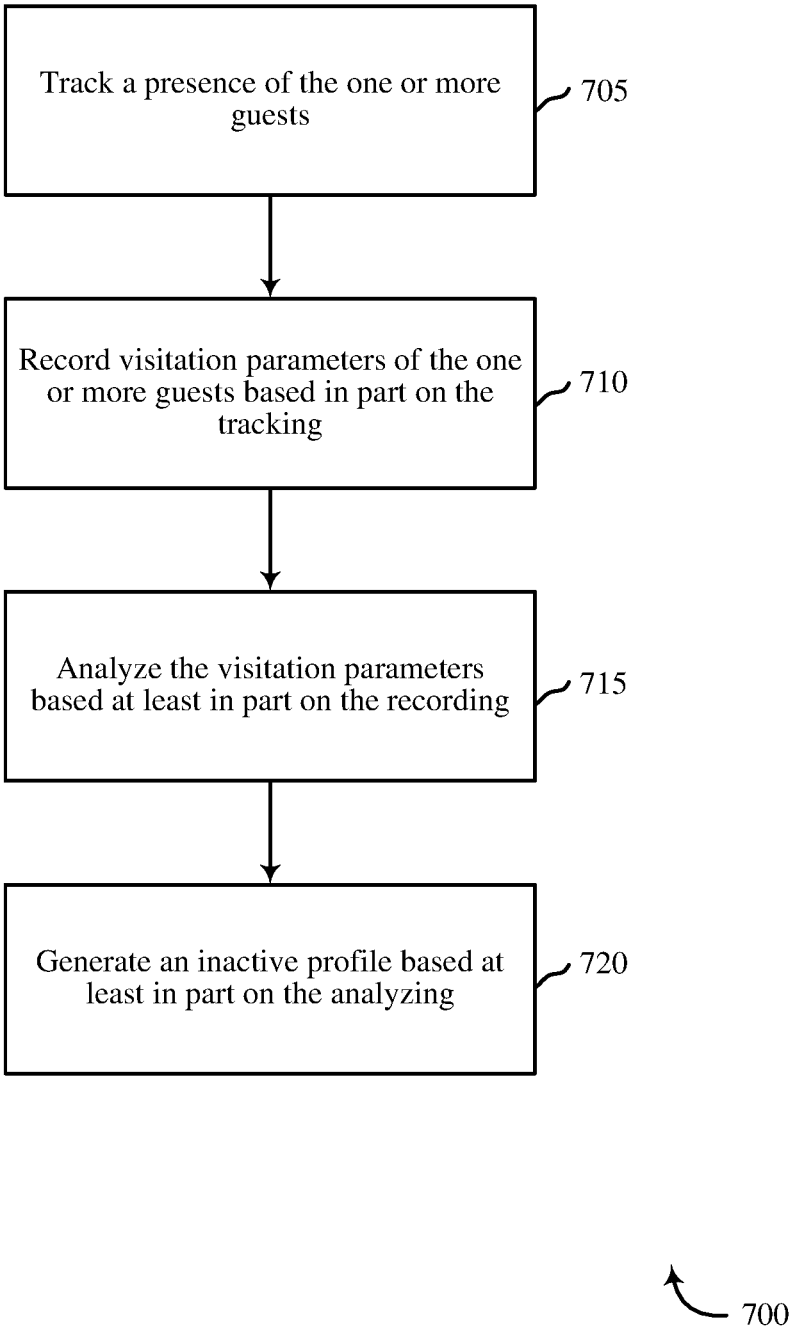
FIG. 7 is a flow chart illustrating an example of a method relating to a security and/or an automation system, in accordance with various aspects of this disclosure.

FIG. 7 is a flow chart illustrating an example of a method 700 for smart doorman systems, in accordance with various aspects of the present disclosure. For clarity, the method 700 is described below with reference to aspects of one or more of the doorman module 215 described with reference to FIGS. 2-4. In some examples, a control panel may execute one or more sets of codes to control the functional elements of a security camera to perform the functions described below. Additionally or alternatively, the control panel may perform one or more of the functions described below using special-purpose hardware.

At block 705, the method 700 may include tracking a presence of the one or more guests. The presence may consist of the arrival of the guest, tracking the presence of a guest through the grounds and/or buildings. The method 700 may additionally detect a duration of the visit and the presence of one or more users associated with the automation system. The tracking may include recording when guests arrive at the premise despite actual entry to the premise. For example, the method 700 may record when a mailman or another delivery personnel arrives. The method 700 may be able to determine if a package is left at the doorstep. If an undesirable situation arises wherein a person is continuously arriving at a residence in a predatory manner, the method 700 may alert a user to the illicit behavior.

The operation(s) at block 705 may be performed using the observation module 305 and tracking module 310 described with reference to FIG. 3.

At block 710, the method 700 may include recording visitation parameters of the one or more guests based in part on the tracking. The method 700 may record the time of visit, length of visit, areas accessed, users present, and the like. The visitation parameters may be stored according to the biometric feature. For example, if the system utilizes facial recognition, for each face detected, the visitation parameters may be recorded. In some instances, the other visitors accompanying the guests may additionally be recorded as part of the visiting parameters.

At block 715, the method 700 may include analyzing the visitation parameters based at least in part on the tracking. Different patterns of visitation may emerge as each visitation parameters is recorded. Additionally, the system may begin to develop a sophisticated recognition pattern using one or more biometric features. For example, the system may initially record several key points for facial recognition. As the number of entries increases, the system may further develop and analyze the facial recognition features to develop a more sophisticated recognition pattern. Additionally, it may be predicted what the pattern of the visits may entail. If the predictions prove mostly accurate, the system may analyze where the predictions were inaccurate and begin to develop a refined user visitation pattern.

The operation(s) at block 710 and 715 may be performed using the tracking module 310 described with reference to FIG. 3.

At block 720, the method 700 may include generating an inactive profile based at least in part on the analyzing. The inactive profile may maintain one or more images of the guest, a history of the visitation parameters relating to the guest, a history of predictions and errors, and the like. In some instances, an administrator may wish to track the inactive profiles and review the information relating to guests to the system. The user may have the option of providing a guest name and additional details surrounding the guest. The inactive profile may provide an additional layer of security as well. If a user notices potential infraction such as a theft, vandalism, or the like, an administrator may review the inactive profiles to determine if there is a pattern to the infractions and guest visits.

The operation(s) at block 720 may be performed using the profile module 315 described with reference to FIG. 3.

Thus, the method 700 may provide for smart doorman systems relating to automation/security systems. It should be noted that the method 700 is just one implementation and that the operations of the method 700 may be rearranged or otherwise modified such that other implementations are possible.

Figure 8:
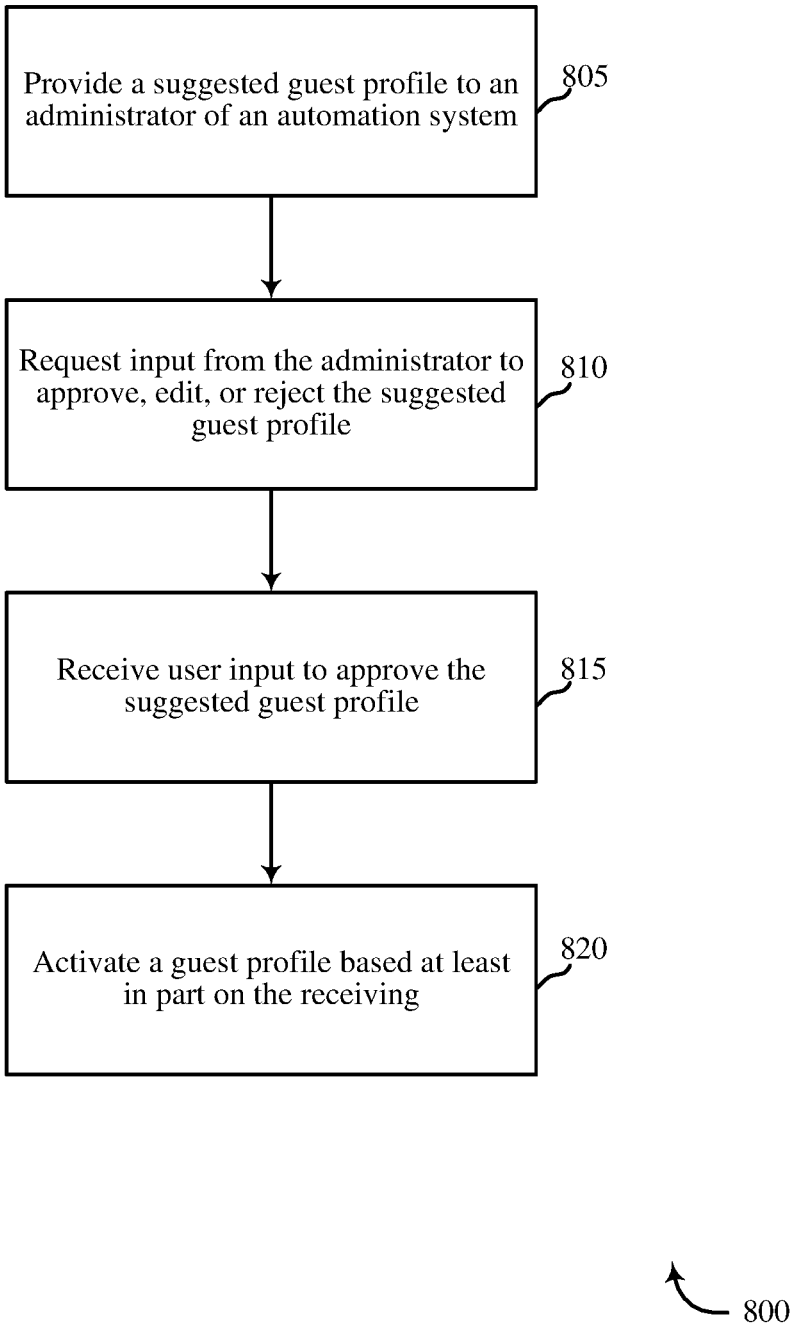
FIG. 8 is a flow chart illustrating an example of a method relating to a security and/or an automation system, in accordance with various aspects of this disclosure.

FIG. 8 is a flow chart illustrating an example of a method 800 for smart doorman systems, in accordance with various aspects of the present disclosure. For clarity, the method 800 is described below with reference to aspects of one or more of the doorman module 215 described with reference to FIGS. 2-4. In some examples, a control panel may execute one or more sets of codes to control the functional elements of a security camera to perform the functions described below. Additionally or alternatively, the control panel may perform one or more of the functions described below using special-purpose hardware.

At block 805, the method 800 may include providing a suggested guest profile to an administrator of the automation system. The suggested profile may comprise one or more profile parameters such as predetermined time frame of access, areas of access, time of access, duration of access, and the like. The predetermined time frame may limit the guest's ability to access the automation system to a specific time period. For example, a guest coming into town may only have access for the week they are visiting. In another embodiment, cleaning personnel, child care, or the like may have access limited to the time frames in which they are expected to fulfill their duties. Additionally, the suggested profile may contain a history of the guest's associated with the automation system to provide the administrator with a clearer understanding of the reasoning behind the access parameters. In some embodiments, a user may have a calendar invite detailing the visit of one or more guests. If the guests are linked to a contact entry with a photograph, a predicted profile may be generated based at least in part on the photo and calendar entry.

At block 810, the method 800 may include requesting input from the administrator to approve, edit, or reject the suggested profile. The administrator may approve the profile as suggested, edit one or more parameters, and then approve the profile. Additionally, the administrator may reject the profile or reject and continue or discontinue the monitoring of the guest. At block 815, the method 800 may include receiving user input to approve the suggested profile. Once the approval is received, at block 820, the method 800 may include activating a guest profile based at least in part on the receiving. Activating the profile may include sending the guest one or more requests to alert them of the change in their status at the automation system. Once a guest has an activated profile, the guest may access the system without the need for a key, key code, or the like. Rather, the user may enter the premises using a biometric feature unique to the guest.

The operation(s) of at blocks 805-820 may be performed using the creation module 320 described with reference to FIG. 3.

Thus, the method 800 may provide for smart doorman systems relating to automation/security systems. It should be noted that the method 800 is just one implementation and that the operations of the method 800 may be rearranged or otherwise modified such that other implementations are possible.

In some examples, aspects from two or more of the methods 600-800 may be combined and/or separated. It should be noted that the methods 600, 700, 800, are just example implementations, and that the operations of the methods 600-800 may be rearranged or otherwise modified such that other implementations are possible.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk, and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A method for a security and/or automation system, comprising:

receiving, from one or more sensors of the security and/or automation system, data associated with at least one guest;

tracking, using one or more processors, a presence of the at least one guest at an entrance to a residence over a pre-determined period of time based at least in part on the received data;

identifying, using the one or more processors, a pattern of visitation of the at least one guest based at least in part on the tracking;

predicting, using the one or more processors, a future visit of the at least one guest to the residence based at least in part on the pattern of visitation of the at least one guest;

generating, using the one or more processors, a suggested guest profile for the at least one guest based at least in part on predicting the future visit; and providing to an administrator of the security and/or automation system, using the one or more processors, the suggested guest profile for the at least one guest.

2. The method of claim 1, further comprising:

detecting the presence of the at least one guest at the entrance to the residence, wherein tracking the presence of the at least one guest is based at least in part on the detecting.

3. The method of claim 2, further comprising:
recording one or more visitation parameters of the at least one guest based at least in part on the detecting; and
analyzing the one or more visitation parameters based at least in part on the recording, wherein identifying the pattern of visitation is based at least in part on the analyzing.

4. The method of claim 1, further comprising:
comparing the presence of the at least one guest to one or more profile parameters; and
predicting the suggested guest profile associated with the at least one guest based at least in part on the comparing.

5. The method of claim 1, further comprising:
generating an inactive profile of the at least one guest based at least in part on one or more visitation parameters of the at least one guest.

6. The method of claim 5, further comprising:
storing the one or more visitation parameters associated with the inactive profile.

7. The method of claim 6, wherein the suggested guest profile is based at least in part on the inactive profile.

8. The method of claim 7, wherein the suggested guest profile comprises one or more access parameters.

9. The method of claim 8, wherein the one or more access parameters comprises one or more of a predetermined time period of access, a daily timeframe access, and one or more access areas.

10. The method of claim 1, further comprising:
requesting input from the administrator to approve, edit, or reject the suggested guest profile.

11. The method of claim 10, further comprising:
receiving user input from the administrator to approve the suggested guest profile; and
activating the suggested guest profile based at least in part on the receiving.

12. An apparatus for security and/or automation systems, comprising:
a processor;
memory in electronic communication with the processor; and
instructions stored in the memory, the instructions being executable by the processor to:
receive, from one or more sensors of the security and/or automation system, data associated with at least one guest;
track a presence of the at least one guest at an entrance to a residence over a pre-determined period of time based at least in part on the received data;
identify a pattern of visitation of the at least one guest based at least in part on the tracking;
predict a future visit of the at least one guest to the residence based at least in part on the pattern of visitation of the at least one guest;
generating, using the one or more processors, a suggested guest profile for the at least one guest based at least in part on predicting the future visit; and
provide to an administrator of the security and/or automation system, the suggested guest profile for the at least one guest based at least in part on the predicting.

13. The apparatus of claim 12, the instructions further executable by the processor to:
detect the presence of the at least one guest at the entrance to the residence, wherein tracking the presence of at least one guest is based at least in part on the detecting.

14. The apparatus of claim 13, the instructions further executable by the processor to:
record one or more visitation parameters of the at least one guest based at least in part on the detecting; and
analyze the one or more visitation parameters based at least in part on the recording, wherein identifying the pattern of visitation is based at least in part on the analyzing.

15. The apparatus of claim 12, the instructions further executable by the processor to:
compare the presence of the at least one guest to one or more profile parameters; and
predict the suggested guest profile associated with the at least one guest based at least in part on the comparing.

16. The apparatus of claim 12, the instructions further executable by the processor to:
generate an inactive profile of the at least one guest based at least in part on one or more visitation parameters of the at least one guest.

17. The apparatus of claim 16, the instructions further executable to:
store the one or more visitation parameters associated with the inactive profile.

18. A non-transitory computer-readable medium storing computer-executable code, the code executable by a processor to:
receive, from one or more sensors of a security and/or automation system, data associated with at least one guest;
track a presence of the at least one guest at an entrance to a residence over a pre-determined period of time based at least in part on the received data;
identify a pattern of visitation of the at least one guest based at least in part on the tracking;
predict a future visit of the at least one guest to the residence based at least in part on the pattern of visitation of the at least one guest;
generating, using the one or more processors, a suggested guest profile for the at least one guest based at least in part on predicting the future visit; and
provide to an administrator of the security and/or automation system, the suggested guest profile for the at least one guest based at least in part on the predicting.

19. The apparatus of claim 18, the instructions further executable to:
detect the presence of the at least one guest at the entrance to the residence, wherein tracking the presence of the at least one guest is based at least in part on the detecting.

20. The apparatus of claim 19, the instructions further executable to:
record one or more visitation parameters of the at least one guest based at least in part on the detecting; and
analyze the one or more visitation parameters based at least in part on the recording, wherein identifying the pattern of visitation is based at least in part on the analyzing.

21. The apparatus of claim 18, the instructions further executable to:
compare the presence of the at least one guest to one or more profile parameters; and
predict the suggested guest profile associated with the at least one guest based at least in part on the comparing.

* * * * *